US005309952A

United States Patent [19]

Speich

[11] Patent Number: 5,309,952

[45] Date of Patent: May 10, 1994

[54] ELECTRO MAGNETIC SHEDDING DEVICE FOR A TEXTILE MACHINE

[75] Inventor: Francisco Speich, Gipf-Oberfrick, Switzerland

[73] Assignee: Textilma AG, Switzerland

[21] Appl. No.: 946,312

[22] PCT Filed: Mar. 2, 1992

[86] PCT No.: PCT/CH92/00042

§ 371 Date: Nov. 5, 1992

§ 102(e) Date: Nov. 5, 1992

[87] PCT Pub. No.: WO92/16679

PCT Pub. Date: Oct. 1, 1992

[30] Foreign Application Priority Data

Mar. 13, 1991 [CH] Switzerland ..... 731/91

[51] Int. Cl.[5] ..... D03C 3/20

[52] U.S. Cl. ..... 139/455

[58] Field of Search ..... 139/455, 65

[56] References Cited

U.S. PATENT DOCUMENTS 4,593,723 6/1986 Griffith .

4,667,704 5/1987 Griffith ..... 139/455 X 4,936,357 6/1990 Keim et al. ..... 139/455

4,969,490 11/1990 Seiler .

FOREIGN PATENT DOCUMENTS 0119787 9/1984 European Pat. Off. ..... 139/455

0348338 3/1989 European Pat. Off. ..... 139/455

3713832 6/1988 Fed. Rep. of Germany ..... 139/455

OTHER PUBLICATIONS

International Search Report dated Jun. 22, 1992.

*Primary Examiner*—Andrew M. Falik

*Attorney, Agent, or Firm*—Diller, Ramik & Wight

[57] ABSTRACT

A shedding device as provided for textile machines which includes oppositely movable lifting blades (41) and pulling elements (42) which are reciprocally movable between a lower shed position and an upper shed position and which are interconnected in pairs by a connecting member (1). The connecting member (1) is connected through a pulley block (2) to a heddle (7) and a retention device (12) is located at a lower shed position and between the pulling elements (42) to control the latter in accordance with the particular pattern program. The insertion device (12) has a wedge-shaped base (17) including a base edge (17*a*) directed toward the harness string (6). Magnetic pull areas (23, 24) are formed at inclined surfaces (20, 21) of the wedge-shape base (17) and through an associated air gap (A) progressive movement of the coupling portion (46) of each pulling element (42) is effected upon magnet energization or coupling/uncoupling operations at low forces and under relatively quiet operation.

17 Claims, 4 Drawing Sheets

Fig.2
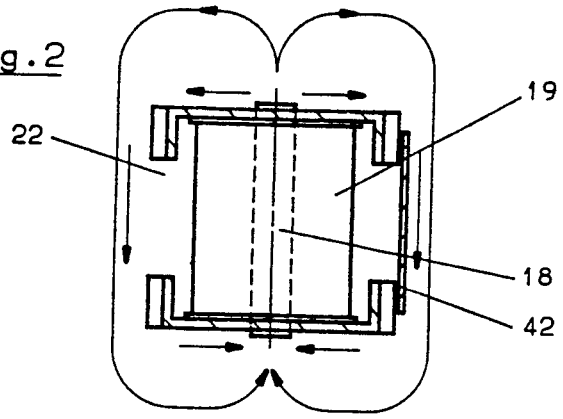
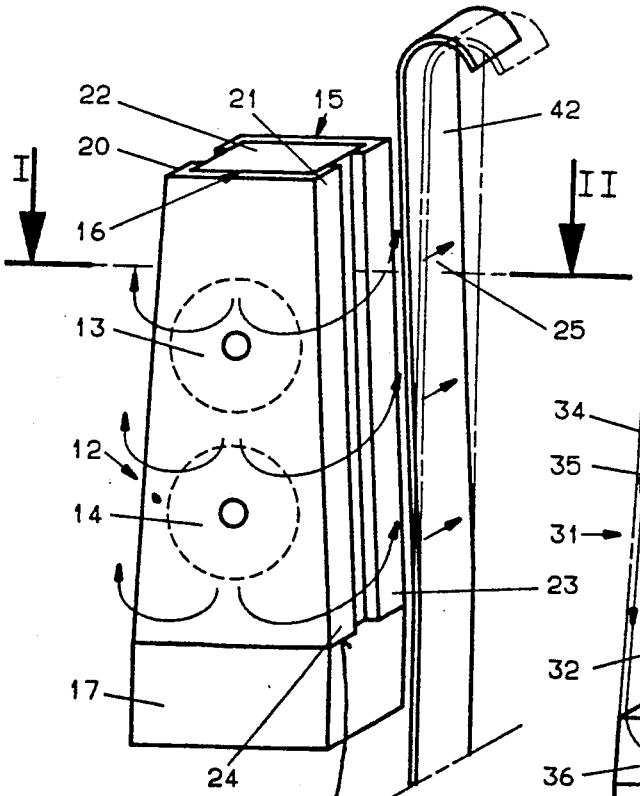
Fig.1
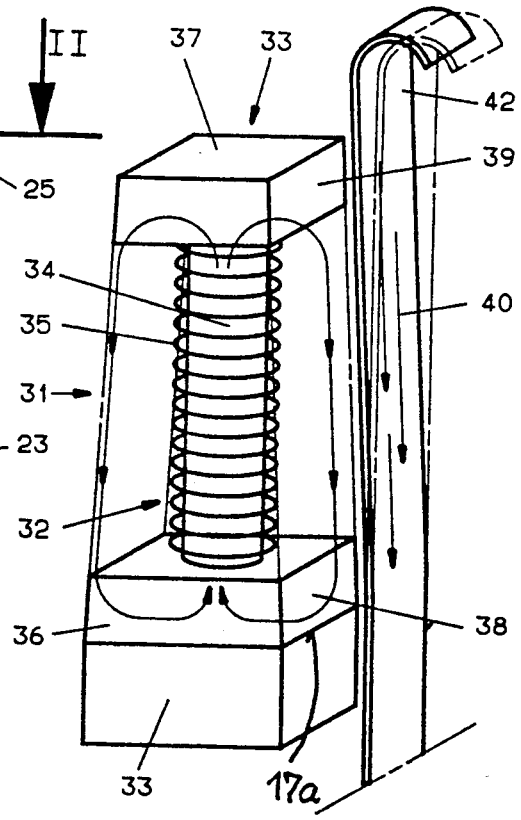
Fig.3

ELECTRO MAGNETIC SHEDDING DEVICE FOR A TEXTILE MACHINE

BACKGROUND OF THE INVENTION

The present invention relates to a shedding device.

A device of this kind is disclosed in the U.S. Pat. No. 4,969,490. In this device the pulling element comprises a supporting heel, which is taken up in the lower shed position by a groove shaped recess of a stationary supporting ledge.

A relatively large distance is present between the electromagnet and the pulling element, such that the pulling element must be pivoted forcefully by the lifting blade toward the electromagnet and must be pivoted back when the electromagnet is not excited by the complete harness string. During this continuous pivoting back and forth of the pulling element, noise is generated and friction occurs on the one hand between the pulling element and the supporting heel and on the other hand between the pulling element and the lifting blade. Such friction leads to the wearing of one or the other or both parts and thus is a serious structural and functional drawback. A further weak point consists in that the restoring force of the pulling element must be produced by the complete harness string. Because the frictional force between the supporting ledge and the supporting heel counteracts same, the complete harness string must be tensioned stronger than necessary.

SUMMARY OF THE INVENTION

Object of the present invention is to provide a shedding device, in which this drawback is eliminated to a large extent and which allows a design having an extremely low mass.

Another object of the present invention is to provide a shedding device which is developed further in such a manner that the drawbacks of known devices are eliminated and oscillations generated by the insertion operation are low which thereby reduces the pulling back force of the complete harness string.

The advantages gained by the invention are to be seen substantially in that

- the oscillations of the pulling elements generated by the insertion operation are low
- the falling off of pulling elements during the upwards and downwards movement is prevented and that therewith
- a rotational speed of 2500 $min^{-1}$ is arrived at
- a substantial reduction of noise is obtained
- a substantial reduction of the restoring pulling force of the slickenside is made possible and
- a large decrease of the wear of pulling elements, retention device, block and tackle devices, cords and slickensides is arrived at.

There is shown in

BRIEF DESCRIPTION OF THE DRAWINGS

FIG. 1 is a perspective view of a first embodiment of an inventive insertion device, FIG. 2 a section along line II—II in FIG. 1, FIG. 3 is a perspective of a second embodiment of an inventive insertion device.

DESCRIPTION OF THE PREFERRED EMBODIMENTS

Figure 7:
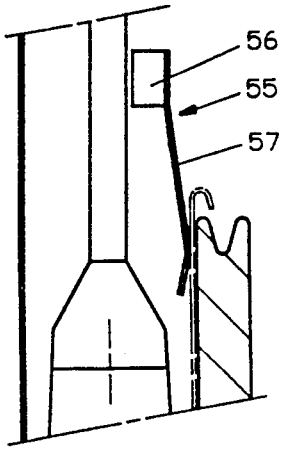
FIGS. 4–13 are diagrammatic views of further embodiments of an inventive shedding device.

A shedding device of the design here under consideration includes a kinematic connecting member 1, which interconnects pulling elements, a pulley block 2 with a first disk 3, around which the connecting member 1 is guided, and a second pulley 4, which is connected to the first disk 3 via web parts 5, a cord 6, which is guided around the second disk 4 and is connected to the heddle 7 for the guiding of warp threads and a restoring spring 8, which is mounted to the end of the heddle 7. The other end of the cord 6 is connected to the machine frame.

The shedding device includes, furthermore, two lifting blades, which are oppositely moveable upwards and downwards, two pulling elements, which are moveable upwards and downwards between a lower and an upper shed position and an electrically controllable magnetic insertion device with a control device.

The lifting blades, pulling elements and the retention device will be described in detail based on the appended drawings for the inventive embodiments of shedding devices.

In FIGS. 1 and 2 a first embodiment of an retention device is illustrated. This insertion device 12 includes two electromagnets 13, 14 and two pole plates 15, 16 and a holder 17, as well. Each electromagnet consists of a cylindrical core 18 and a winding 19, which is wound on the core (FIG. 2).

Each pole plate 15, 16 has a U-shaped cross section, which decreases along the length of the pole plate, such that the legs 20, 21 form inclined surfaces. The pole plates 15, 16 are arranged in such a manner, that the ends of the legs are at a distance oppositely of each other. The electromagnets 13, 14 are located between the pole plates 15, 16. The electromagnets 13, 14 and the pole plates 15, 16 are interconnected by a plastic material mass 22, which fills the hollow spaces between the pole plates and the gap between the ends of the legs. By means of this a wedge shaped unit having two inclined surfaces is arrived at.

Such as illustrated in FIG. 1, a portion of the pulling element 42 is attracted when the electromagnets 13, 14 are excited, such that this portion comes to lay against the inclined surfaces, which are formed by the outer surface of the legs 20, 21 of the pole plates. In this case the pole plates form pole areas 23 and 24, such that the lines of flux 25 of the electromagnets are directed in a lateral direction relative to the pulling element 42. A base edge 17A is formed by the lower broader portion of this insertion device 12.

FIG. 3 illustrates a second embodiment of an retention device. This insertion device 31 has an electromagnet 32 and a support 33 for the electromagnet. The electromagnet 32 consists of a double-T-shaped core 34 and a winding 35. The core 34 has a web portion, on which the winding is arranged in an insulated manner and a broader base flange 36 and a narrower flange 37, which include inclined surfaces at the sides facing the pulling elements 42, which form defines pole areas 38 and 39 and accordingly the base edge.

It is illustrated in FIG. 3, that a portion of the pulling element 42 is attracted when the electromagnet 32 is excited, such that this portion comes to lay on the inclined surfaces of the flanges 36, 37 of the core 34, whereby the lines of flux 40 are directed in the longitudinal direction of the pulling element 42. By means of this, the magnetic circuit is short-circuited, such that the power consumption of the electromagnet 32 is decreased in an advantageous manner.

Figure 6:
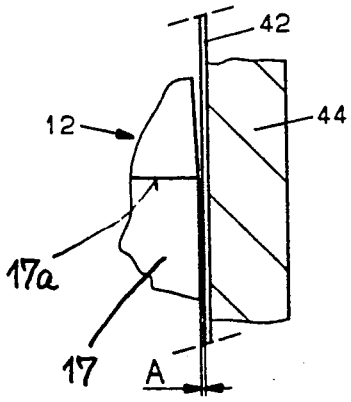

The inventive shedding device illustrated in FIGS. 4 to 7 includes two lifting blades 41, which are oppositely moved upwards and downwards by a not illustrated driving device, two pulling elements 42, which can be brought to engage and disengage the lifting blades 41, an retention device 12 illustrated in FIGS. 1 and 2 with a not specifically illustrated control circuit 58, and which are located at the area of the lower shed position of the pulling elements 42 and two guide portions 43, 44, between which the retention device 12 is arranged in such a manner, that the pulling elements 42 attain a defined position relative to the pole areas (23, 24;) of the retention device 12 (FIG. 1). In this position an air gap A of a maximal width of less than 1 mm, preferably almost zero, is present between the base edge 17*a* of the pole areas and the pulling element 42 (FIG. 6). In order to improve the guiding of the pulling elements 4, groove-like recesses can be foreseen in the guiding members 43, 44.

Figure 4:
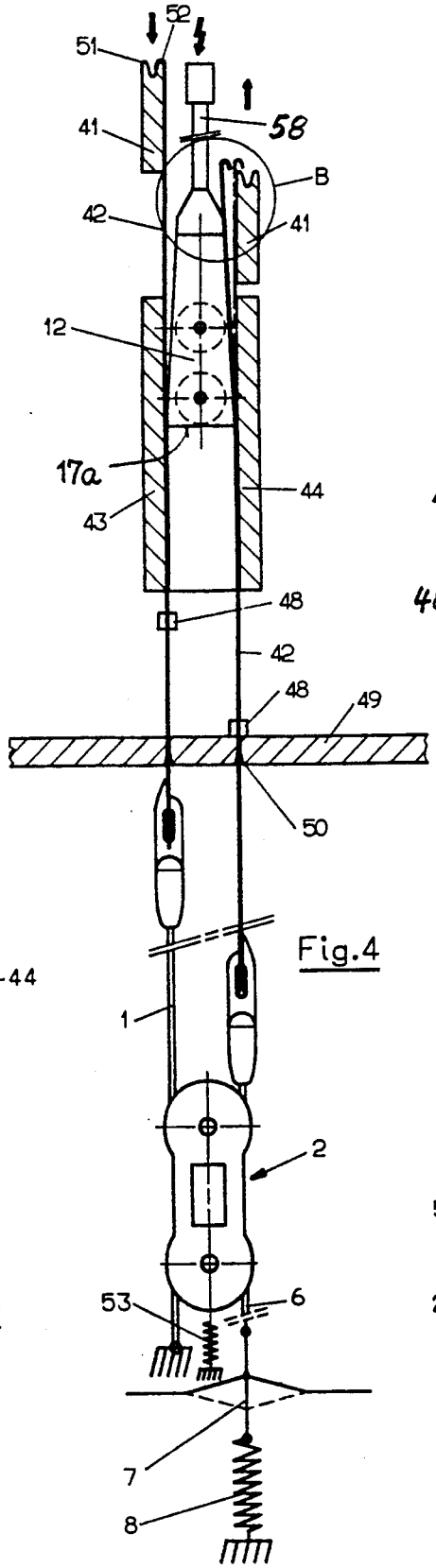

The pulling element 42 is of a strip-like design. At the lower end the pulling element 42 is connected to the kinematic connecting member 1. The upper end is designed as hook shaped portion 45, which can be brought to engage and to disengage the lifting blade 41. The pulling element 42 is divided into a coupling portion 46, which is adjacent the hook shaped portion 45 and a guiding portion 47 adjoining same. An abutment part 48 is located in the guiding portion 47, which e.g. lies on an abutment board 49, when the pulling element 42 is in the lower shed position (FIG. 4). The guiding portion 47 is guided in an opening 50 in the abutment board 49. The members 1, 48, 2, 6, 7 and 8 collectively are called a "complete harness string."

The pulling element 42 can consist of a metal, which is magnetizable. It is likewise possible to use a pulling element consisting of a plastic material, whereby the coupling portion 46 can consist of a magnetizable material or must contain such a material.

At the longitudinal edge the lifting blades 41 are equipped with two parallel extending portions 51, 52, into which the hook shaped sections 45 hook in.

A tension spring 53 is hooked onto the pulley block 2 in order to pretension the pulling elements 42 in the direction of the shed to be formed.

It is, however, also possible to allocate a spring to every pulling element 42.

Figure 5:
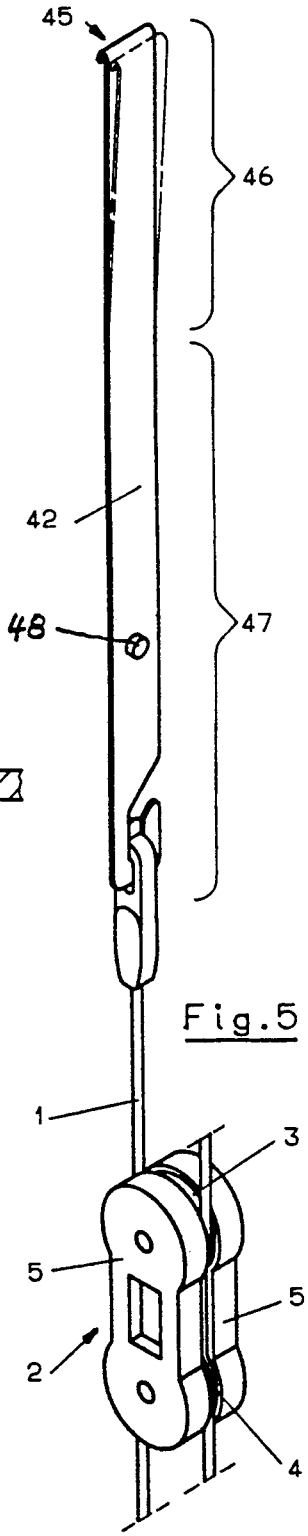

In FIG. 5 the pulling element 42 is designed integrally. It is, however, also possible to design the pulling element in two parts, whereby then the coupling portion 46 and the guiding portion 47 are interconnected as separate structures by suitable means.

The shedding device is equipped with a resetting device 55 in order to lift the coupling portion 46 of the pulling element 42 off the retention device 12, when the electromagnets 13, 14 (FIG. 1) are not excited. To this end, the resetting device 55 can consist of a support 56 and a leaf spring 57 and be e.g. mounted at the retention device 12.

FIGS. 8 to 11 illustrate a further embodiment of an inventive shedding device.

The shedding device is designed in a space saving manner and comprises two lifting blades 101, two pulling members 102, guide parts 103 for the lifting blades, an retention device 12 illustrated in FIG. 1 and two guiding elements or guides 104, between which the retention device 12 is arranged in such a manner, that the pulling elements 102 attain a defined position relative to the pole areas 23, 24 (FIG. 1).

Figures 8, 9, 10, 11:
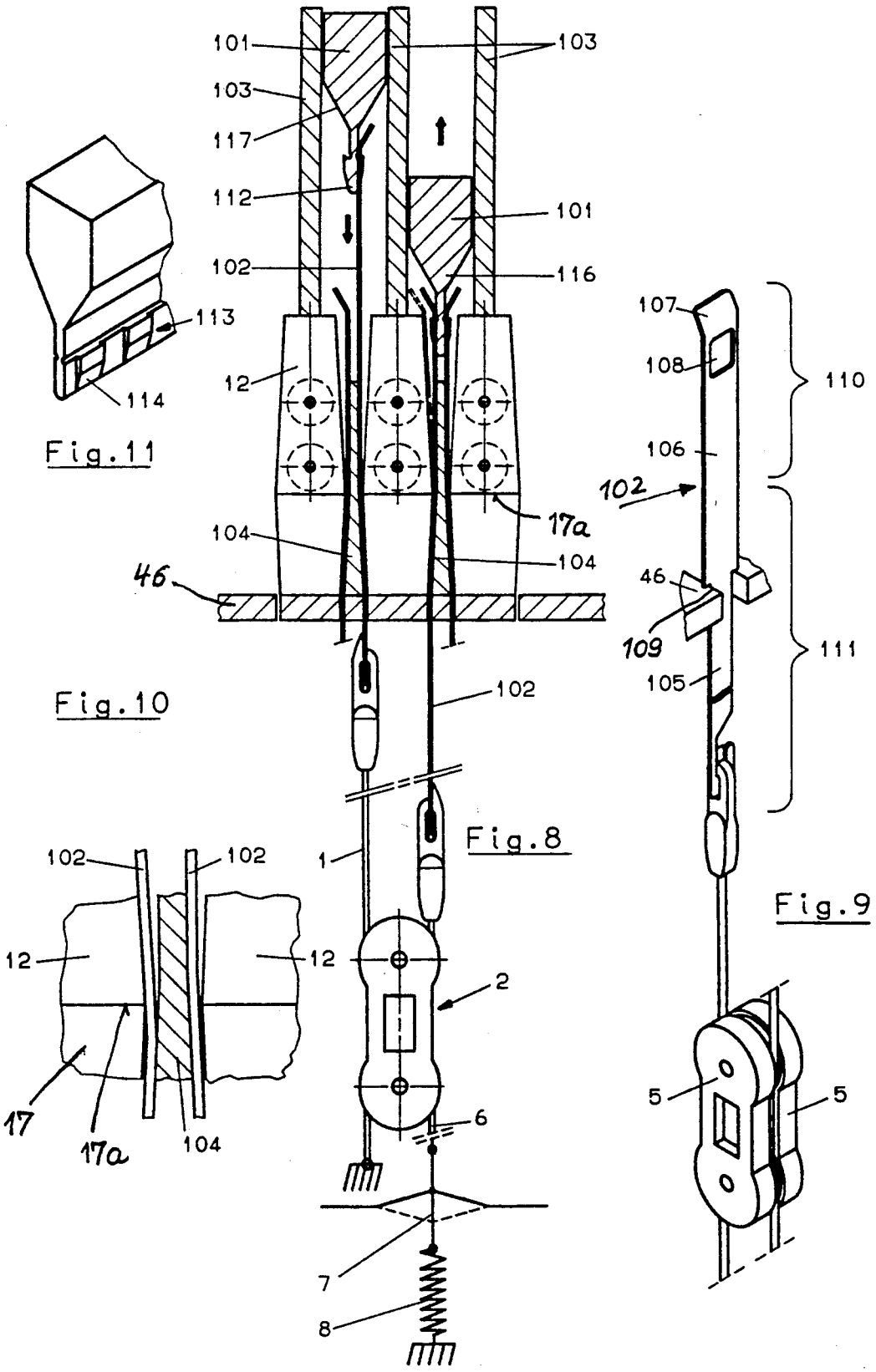

As shown in FIGS. 8+9, the guiding element or guide 104 is designed in such a manner, that the pulling element 102 is guided at the respective lower base edge 17*a* of the retention device, wherewith the pulling element contacts the pole areas 23, 24 with a minimal air gap. It is, thereby, specifically advantageous, that the pulling element 102 extends inclined relative to the base surface of the retention device 12. By means of such, a defined restoring force of the coupling portion 110 is arrived at.

The pulling element 102 is designed in a strip-like manner and consists of an elastically deformable material. The pulling element consists of a narrow portion 105, onto the free end of which the connecting member 1 is hooked on, and a broad portion 106, of which the free end comprises a portion 107 which is inclined relative to the plane of the strip. A rectangular opening 108 is formed below the portion 107. By means of the two portions 105 and 106 a shoulder 109 is formed at the pulling element, which lies on the abutment board 46, when the pulling element 102 is in its lower shed position. Furthermore, the pulling element is divided into the coupling portion 110 and a guide portion 111.

The lifting blade 101 has at its narrow side facing downwards a projection 112 with hook shaped portions 113, which project from the side surfaces of the projection 112 and can be brought to engage and disengage the openings 108 in the pulling element.

A ramping surface 114 is formed by the projecting portions 113. The portion 112 is adjoined by a broadened portion 116 having inclined surfaces 117, which passes into the head portion of the lifting blade 101. During the downwards movement of the lifting blade 101 the inclined portion 107 of the pulling element is placed onto the inclined surface 117 and by the continued downwards movement of the lifting blade the coupling portion 110 is deflected and comes to lay on the pole areas 23, 24 (FIG. 1) of the retention device 12.

Figure 12:
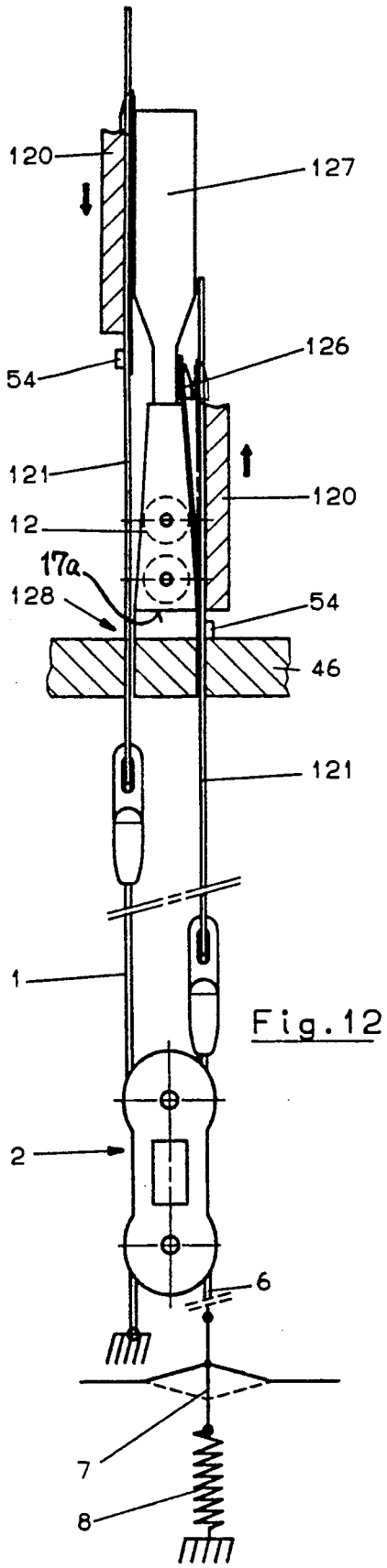
Figure 13:
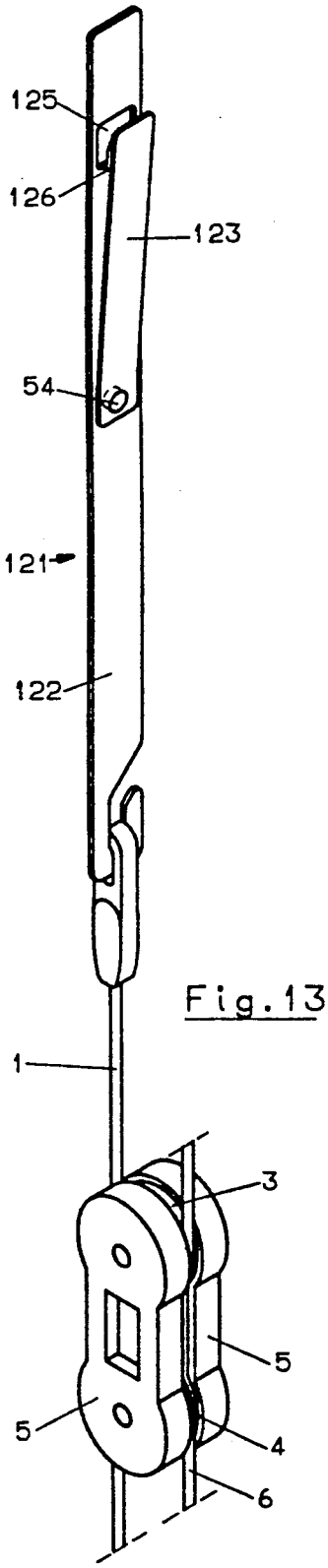

FIGS. 12 and 13 illustrate a further embodiment of the inventive shedding device.

The shedding device includes two lifting blades 120, two pulling elements 121 and an retention device 12 illustrated in FIG. 1, which is arranged in such a manner, that it is located between the pulling elements 121, when latter are in the lower shed position. In this lower shed position the pulling elements attain a defined position relative to the pole areas 23, 24 (FIG. 1).

The pulling element 121 comprises a strip shaped guide portion 122 and a strip shaped coupling portion 123, which is fixed on the guide portion 122. The guide portion 122 is connected at one end to the kinematic connecting member 1. At the area of the other end a rectangular opening 125 is foreseen. The guide portion 122 consists advantageously of a material, which is not magnetizable. Each pulling element 121 has a stop member 54, which projects outwards towards the lifting blade 120 and is mounted to the guide portion 122 and which e.g. lies on the abutment board 46, when the pulling element 121 is in the lower shed position, or which causes the lifting blade 120 moves the pulling element 121 positively into the lower shed position.

The coupling portion 123 has at one end a hook shaped portion 126 which can project through the opening 125 and serves as a locked connection with the lifting blade. The coupling portion 123 consists of an elastically deformable material, which is magnetizable and is pivoted to the magnet pole 23, 24. A two-part design of this pulling element 121 is specifically advantageous, because no magnetic attraction force is exerted onto the guide portion 122.

A guide member 127 which serves as a restoring cam is located above the retention device 12, and the coupling portions 123 contact this guide member 127, when the pulling element 121 is in the upper shed position. An opening 128 is foreseen in the abutment board 46, in which the guide portion 122 is guided during the upwards and downwards movement. Accordingly, a double guiding for the pulling element 121 is arrived at. The guiding can be improved, when a groove shaped recess is foreseen in the guide member 127, which receives the coupling portion 123 during the upwards and downwards movement of the pulling member, such that the guide portion 122 is guided at the edges of the guide member 127.

Although a preferred embodiment of the invention has been specifically illustrated and described herein, it is to be understood that minor variations may be made in the apparatus without departing from the spirit and scope of the invention, as defined the appended claims.

I claim:

1. A shedding device for textile machines, specifically jacquard machines, comprising oppositely movable lifting blades (41) and pulling elements (42) which are reciprocally movable between a lower shed position and an upper shed position and which are interconnected in pairs by a kinematic connecting member (1), said kinematic connecting member (1) being connected through a pulley block (2) to a heddle (7), a retention device (12) which comprises at least one electromagnet, said retention device (12) being located at the lower shed position and between the pulling elements (42) to control the pulling elements (42) in accordance with a pattern program in such a manner that the pulling element resting in its lower shed position on a detent (51) of the lifting blade (41) can be brought into or out of engagement with the lifting blade (41) in order to move the pulling element (42) into the upper shed position or to leave it in the lower shed position, said retention device (12) having a wedge shaped base (17) with a base edge (17*a*) thereat directed toward a harness string (6), said electromagnet having two defined magnet pole areas (23, 24) which are formed at inclined surfaces (20, 21) of said wedge shaped base (17) whereby the retention device (12) is arranged in such a manner that the inclined surfaces (20, 21) are located opposite the pulling elements (42), an air gap (A) of maximal 1 mm is present at a path of movement of the pulling elements (42) below the base edge (17*a*) formed by the inclined surfaces, each pulling element (42) has a strip-like form and a guiding portion (47) for guiding said pulling element (42) below said retention device (12) in an opening (50) of an abutment board (49), and each pulling element (42) has a coupling portion (46) which is operatively connected to the electromagnet (13, 14) in order to couple or uncouple each pulling element (42) relative to its associated lifting blade (41).

2. The shedding device as defined in claim 1 wherein the magnet pull areas (23, 24) are spaced from each other and are parallel relative to the path of movement of the pulling elements (42).

3. The shedding device as defined in claim 1 wherein the magnet pull areas (23, 24) are spaced from each other and are laterally disposed relative to the path of movement of the pulling elements (42).

4. The shedding device as defined in claim 1 wherein the at least one electromagnet is constructed and arranged relative to the pulling elements (42) such that the magnetic flux therefrom acts directly onto the pulling elements (42).

5. The shedding device as defined in claim 1 wherein each pulling element is of an integral one-piece construction.

6. The shedding device as defined in claim 1 wherein each pulling element (42) is of a multiple part construction.

7. The shedding device as defined in claim 1 wherein each pulling element (42) is constructed of plastic material.

8. The shedding device as defined in claim 1 wherein each pulling element (42) is constructed of metal.

9. The shedding device as defined in claim 1 wherein each coupling portion (46) of an associated pulling element (42) is constructed of a flexible material.

10. The shedding device as defined in claim 1 wherein at least said coupling portion (46) of each pulling element (42) is constructed of magnetizable material.

11. The shedding device as defined in claim 1 wherein each coupling portion (46) of each pulling element (42) is arranged to deflectable relative to its guiding portion (47).

12. The shedding device as defined in claim 1 including a resetting device (55) for lifting the coupling portion (46) off the pole areas of the associated electromagnet (13, 14) upon deenergization thereof.

13. The shedding device as defined in claim 1 wherein each coupling portion (46) is constructed from material of which the elasticity determines the restoring force in order to lift the coupling portion (46) off the pole areas of the electromagnetic (13, 14) upon the de-energization of the latter.

14. The shedding device as defined in claim 1 including a guiding device (43, 44) for each pulling element (42) which holds the guiding portion (47) thereof at a defined distance relative to the retention device (12).

15. The shedding device as defined in claim 1 including a spring (53) for pretensioning each pulling element (42) in the direction of a heddle draw between the upper and lower shed positions.

16. The shedding device as defined in claim 1 including means (126) defining a locked interconnection between each pulling element (121) and its associated lifting blade (120, FIG. 12) during movement thereof.

17. The shedding device as defined in claim 16 wherein said last-mentioned means includes restoring cams.

* * * * *